US010220360B1

(12) United States Patent
Wang et al.

(10) Patent No.: US 10,220,360 B1
(45) Date of Patent: Mar. 5, 2019

(54) LIQUID MIXING APPARATUS

(71) Applicant: AROTEC CORPORATION, New Taipei (TW)

(72) Inventors: Ching-Hua Wang, New Taipei (TW); Yu-Wen Yen, New Taipei (TW)

(73) Assignee: AROTEC CORPORATION, New Taipei (TW)

( * ) Notice: Subject to any disclaimer, the term of this patent is extended or adjusted under 35 U.S.C. 154(b) by 0 days.

(21) Appl. No.: 15/672,308

(22) Filed: Aug. 9, 2017

(51) Int. Cl.
*B01F 13/00* (2006.01)
*B65D 1/32* (2006.01)

(52) U.S. Cl.
CPC ..... *B01F 13/0061* (2013.01); *B01F 13/0064* (2013.01); *B01F 13/0074* (2013.01); *B65D 1/32* (2013.01)

(58) Field of Classification Search
CPC ..... B01F 13/0061; B01F 13/0064; B01F 13/0074; B65D 1/32
See application file for complete search history.

(56) References Cited

U.S. PATENT DOCUMENTS 7,771,655 B2 * 8/2010 Ramel ..... G01N 33/49 422/63
2016/0263596 A1 * 9/2016 Wang ..... B05B 7/0425

* cited by examiner

*Primary Examiner* — Anshu Bhatia
(74) *Attorney, Agent, or Firm* — Leong C. Lei

(57) ABSTRACT

During the use of a liquid mixing apparatus, a liquid container can be installed onto an adapter. The liquid container drives a lifting assembly to allow a piercing assembly to pierce through the adapter. Once a fluid flows into a flowing passage portion via a fluid inlet, a portion of the fluid is pressurized via a branch passage portion with easy control and further flows into the liquid container to mix with a fragrance material inside the liquid container. The mixed fragrant liquid then flows out of a fluid outlet from the piercing assembly via the return passage portion and the flowing passage portion. With the pressurization design of the branch passage portion, the apparatus allows the increase of dimension to increase the flow rate while maintaining the pressurized liquid, which is convenient to use and facilitated for the control of the mixture amount with greater variation range.

10 Claims, 7 Drawing Sheets

LIQUID MIXING APPARATUS

(a) TECHNICAL FIELD OF THE INVENTION

The present invention is related to a liquid mixing apparatus convenient to use and facilitated to control the amount of mixture with a greater variation range.

(b) DESCRIPTION OF THE PRIOR ART

A known fluid type of fragrance device comprises a housing, a container space inside the housing, a channel opening formed on the housing and connected to the container space and a fragrance material received inside the container space. During the use of such known fluid type of fragrance device, the device is installed on the flowing path of the fluid used for washing or flushing, such as the installation on the (shower head) water supply pipe or (toilet) reservoir tank, in order to allow the fluid to contact with the fragrance material for mixing with each other such that fragrance can be introduced into the fluid.

However, through actual experiments, it is found that since there is no special structure provided to increase the fluid pressure before the direct contact between the fluid and the fragrance material, the pressure of the fluid before contacting the fragrance material is close to the pressure of the fluid after contacting the fragrance material. As a result, the flowing pressure of fluid being controlled is insufficient such that interference occurs, leading to the drawback of improper flow of the fluid and, consequently, the drawback of unstable amount of mixture of the fragrance with the flowing fluid. In addition, due to the issue of insufficient pressure of the flowing fluid in the known fluid type of fragrance device, the amount of the flow of the fluid in contact with the fragrance material cannot be controlled and increased. If the amount is increased forcefully, it can lead to more adverse effect of improper fluid flow and unstable mixture amount, or the situation where a portion of the fluid is accumulated at the area of the fragrance material without flowing. Since most of the flowing fluid actually flows out without contacting with the fragrance, the flow rate of the fluid with the use of such known fluid type of fragrance device is limited and cannot be increased effectively.

SUMMARY OF THE INVENTION

An objective of the present invention is to facilitate users' use of a fragrance apparatus.

Another objective of the present invention is to allow the arbitrary change of the dimensions of the apparatus during the production of the apparatus in order to control the amount of mixture thereof.

To achieve the aforementioned objectives, the apparatus of the present invention comprises a connecting device having one side formed of a fluid inlet and another side formed of a fluid outlet, and a flowing passage portion is formed inside the connecting device and connected to the fluid inlet and the fluid outlet. In addition, the internal of the connecting device is formed of a branch passage portion connected to the flowing passage portion. The branch passage portion comprises a branch flow space and a branch flow opening connected to the branch flow space and the flowing passage portion. In addition, the internal of the connecting device is formed of a return passage portion connected to the flowing passage portion. In addition, the return passage portion comprises a return flow space and a return flow opening connected to the return flow space and the flowing passage portion. Furthermore, the connecting device includes a lifting assembly moveably arranged thereon, and the lifting assembly includes a piercing assembly moveably arranged thereon. In addition, the piercing assembly comprises a first piercing member selectively connected to the branch passage portion and a second piercing member selectively connected to the return passage portion. The connecting device further includes an adapter arranged at a location corresponding to the piercing assembly.

When the apparatus is not in use, the fluid is able to flow from the fluid inlet to the fluid outlet via the flowing passage portion.

When the apparatus is in use, the user can simply install the liquid container onto the adapter; therefore, the apparatus is facilitated for use. In addition, the liquid container is able to naturally trigger the lifting assembly to allow the first piercing member and the second piercing member of the piercing assembly to protrude out of the lifting assembly and to pierce into the liquid container; thereby allowing the first piercing member to connect to the branch passage portion and the second piercing member to connect to the return passage portion. As a result, the fluid flowing into the flowing passage portion via the fluid inlet can have a portion of the fluid flowing into the branch flow space via the branch flow opening, and it is also able to enter into the liquid container via the first piercing member in order to increase the pressure of the fluid flowing toward the liquid container. Consequently, the flow of the fluid is smooth and is able to mix with the fragrance inside the liquid container; following which it is able to exit from the fluid outlet via the second piercing member, the return flow space, the return flow opening and the flowing passage portion.

When it is not in use or during the replacement of the liquid container, the liquid container can be directly removed from the adapter, and the lifting assembly is able to return to its original position automatically and drive the piercing assembly together in order to allow the first piercing member and the second piercing member to retract back into the lifting assembly as well as sealing the branch passage portion and the return passage portion.

When there I a need for the flow rate of the fluid for mixing, since the structural design of the branch passage portion allows the pressure of the fluid flowing toward the liquid container to increase, the dimensions of the branch passage portion and the return passage portion can be increased under the condition of maintaining the pressurization in order to increase the flow rate. In addition, the range of increase of the dimension is relatively large. With the aforementioned technique, the drawback of the known fluid type of fragrance device can be overcome while achieving the effects of convenience use, facilitated control of amount of mixture and relatively large of variable range.

DETAILED DESCRIPTION OF THE PREFERRED EMBODIMENTS

Figure 1:
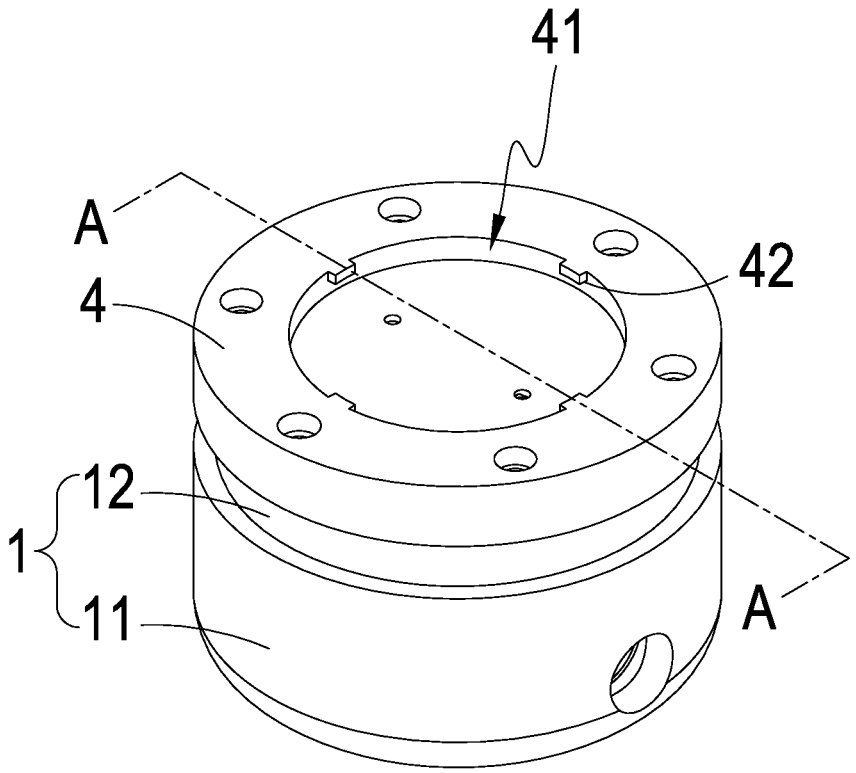
FIG. 1 is a perspective view of the structure of the apparatus of the present invention.
Figure 2:
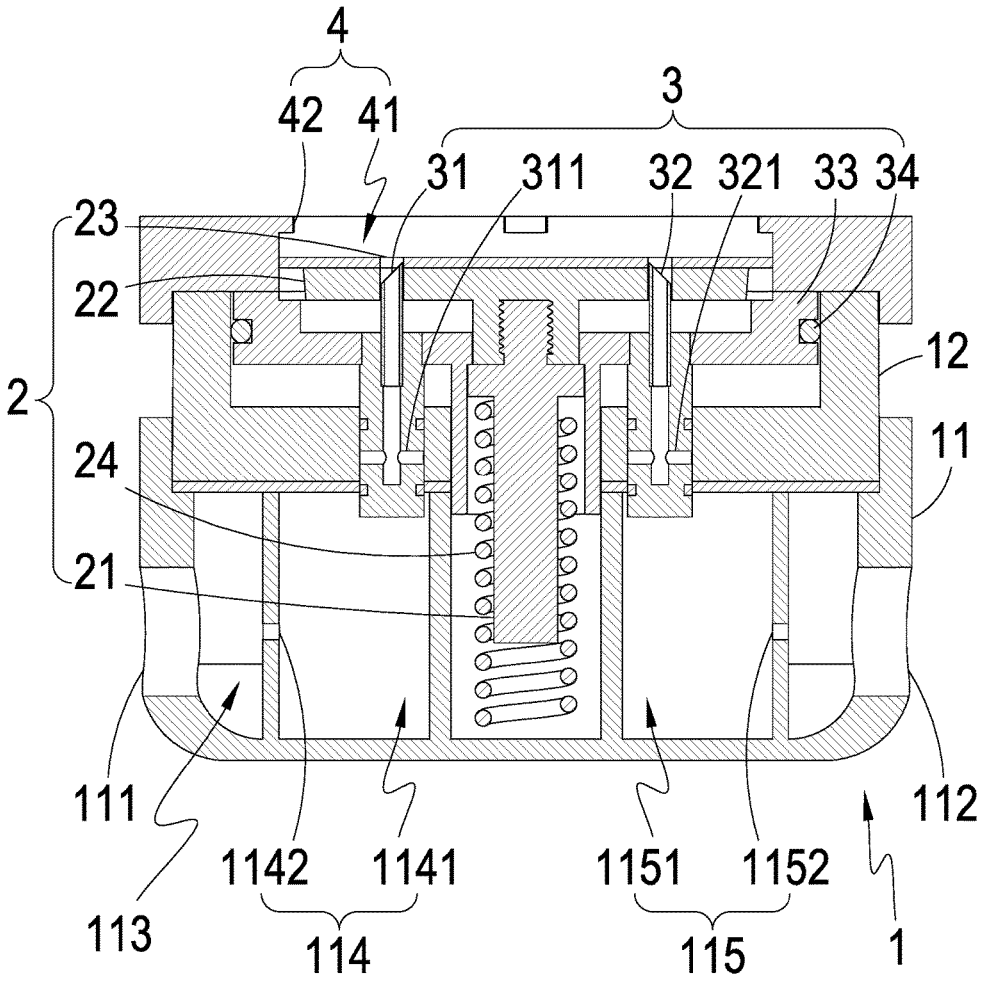
FIG. 2 is a cross sectional view taken along line A-A as shown in FIG. 1 of the present invention.
Figure 3:
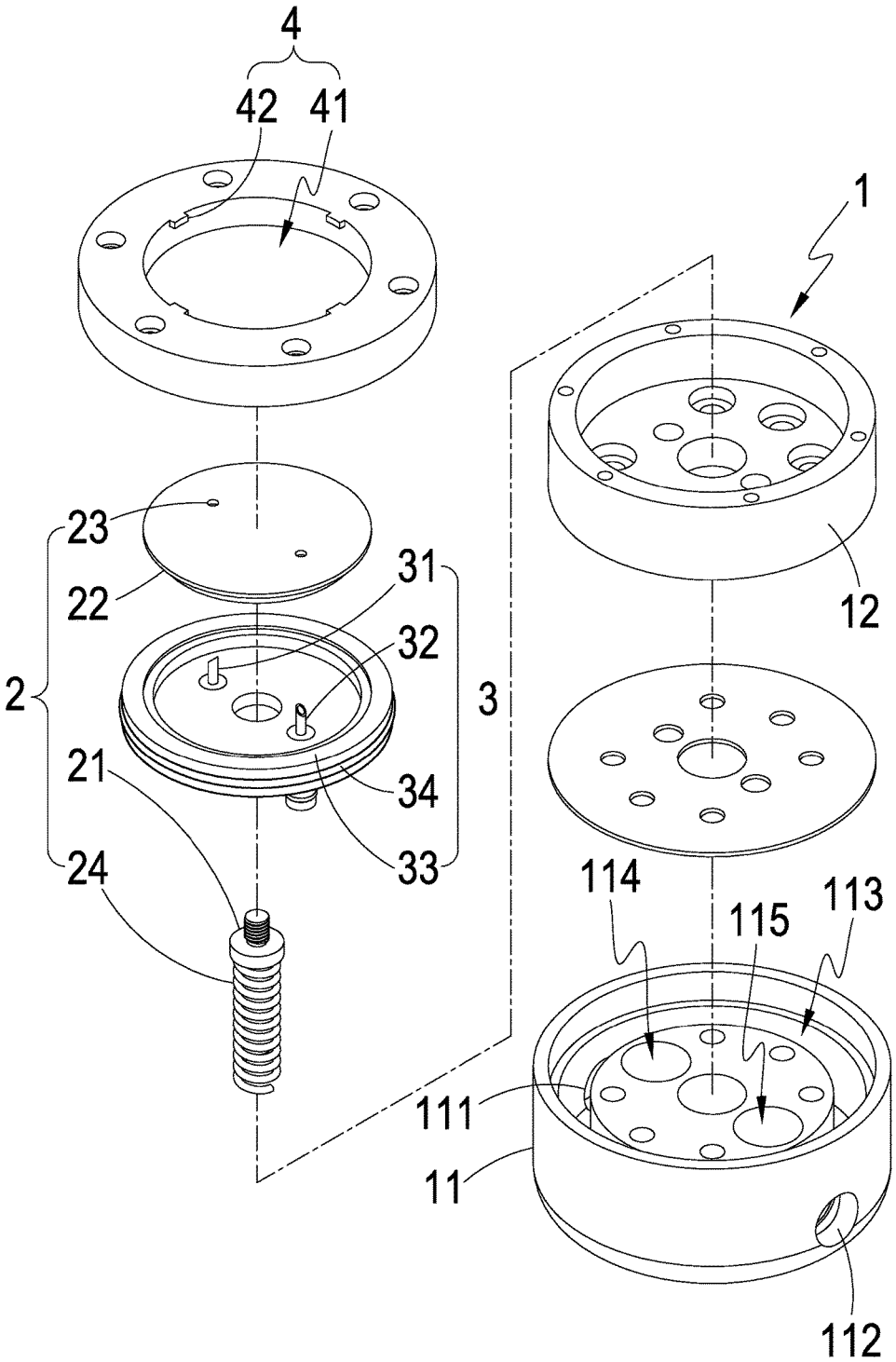
FIG. 3 is an exploded view of the apparatus of the present invention.
Figure 4:
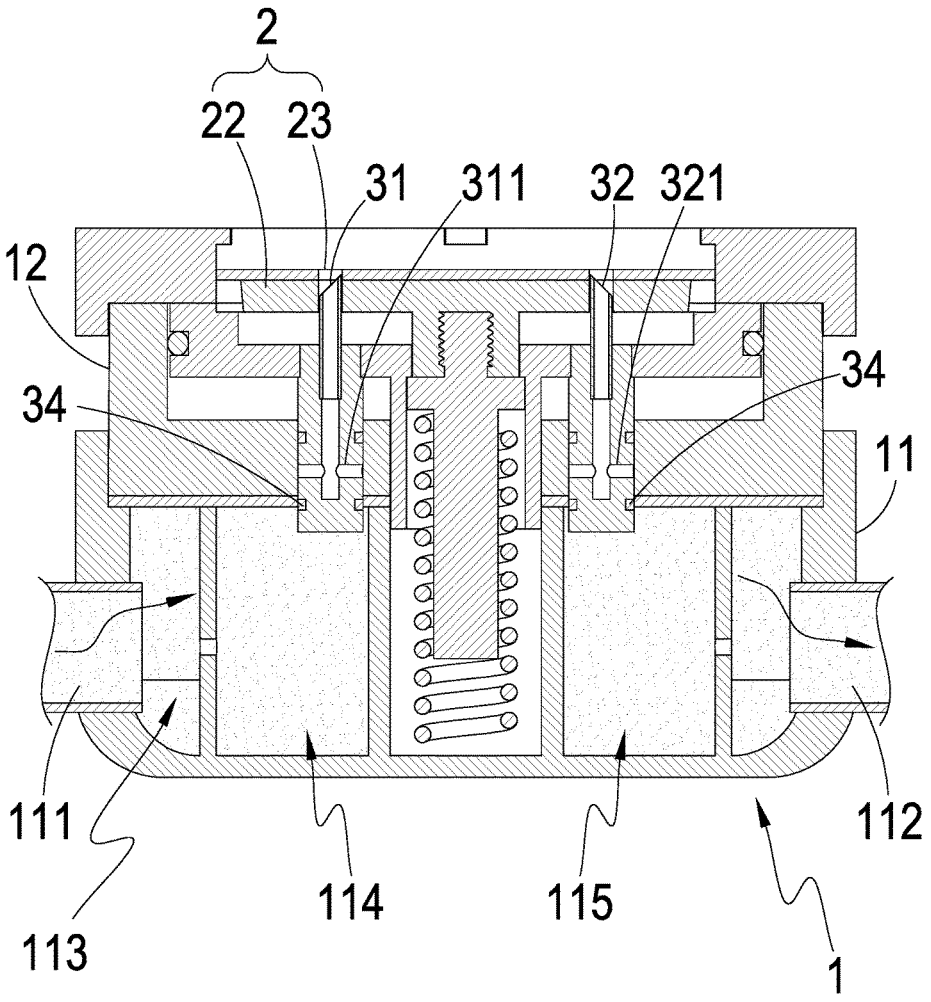
FIG. 4 is an illustration showing the setup of the apparatus of the present invention.

As shown in FIG. 1 to FIG. 3, the liquid mixing apparatus of the present invention mainly comprises at least one connecting device 1, at least one lifting assembly 2, at least one piercing assembly 3, at least one adapter 4; wherein the connecting device 1 includes one side formed of at least one fluid inlet 111 and another side formed of at least one fluid outlet 112. In addition the internal of the connecting device 1 is formed of at least one flowing passage portion 113 connected to the fluid inlet 111 and the fluid outlet 112. A side area of the flowing passage portion 113 inside the connecting device 1 includes at least one branch passage portion 114 connected thereto, and a side area of the flowing passage portion 113 inside the connecting device 1 includes at least one return flow portion 115 connected thereto.

The lifting assembly 2 is movably arranged on the connecting device 1. The piercing assembly 3 is movably arranged on the lifting assembly 2 and configured to move along therewith, which is located between the lifting assembly 2 and the connecting device 1. The piercing member 3 comprises at least one first piercing member 31 selectively connected to the branch passage portion, at least one second piercing member 32 selectively connected to the return passage portion 115, and a carrier 33 moveably arranged on the lifting assembly 2 and provided for the first piercing member 31 and the second piercing member 32 to install thereon. Furthermore, the first piercing member 31 and the second piercing member 32 are configured to selectively pierce into a side area of the lifting assembly 2 facing away from the connecting device. In addition, the first piercing member 31 includes at least one first through hole 311 formed thereof and selectively connected to the branch passage portion 114, and the second piercing member 32 includes at least one second through hole 321 formed thereon and selectively connected to the return passage portion 115. Moreover, at least one sealing unit 34 is formed on top of the carrier 33, the first piercing member 31 and the second piercing member 32 in order to increase the sealing effect.

The connecting device 1 comprises at least one connecting main body 11 formed of the fluid inlet 111, the fluid outlet 112, the flowing passage portion 113, the branch passage portion 114 and the return passage portion 115 thereon, and at least one connecting cover 12 formed on the connecting main body 11 and having the first piercing member 31 and the second piercing member 32 inserted therein. In addition, the branch passage portion 114 comprises at least one branch flow space 1141 selectively connected to the first piercing member 31 and at least one branch flow opening 1142 connected to the branch flow space 1141 and the flowing passage portion 113. Furthermore, the return passage portion 115 comprises at least one return flow space 1151 selectively connected to the second piercing member 32 and at least one return flow opening 1152 connected to the return flow space 1151 and the flowing passage portion 113.

The lifting assembly 2 comprises at least one first abutment member 21 moveably arranged on the connecting device 1, at least one second abutment member 22 arranged on a side portion of the first abutment member 21 facing away from the connecting device 1 and at least one elastic unit 24 arranged on the first abutment member 21. The first abutment member 21 and the second abutment 22 clamp to hold the piercing assembly 3. The second abutment member 22 is configured to allow the first piercing member 31 and the second piercing member 32 to selectively pierce therethrough. Moreover, the second abutment member 22 includes a plurality of piercing portions 23 defined thereon to allow the first piercing member 31 and the second piercing member 32 to selectively pierce therethrough; and the piercing portions 23 are configured to selectively receive the first piercing member 31 and the second piercing member 32.

The adapter 4 is arranged on the connecting device and at a location corresponding to the piercing assembly 3. The adapter 4 comprises at least one receiving portion 41, at least one pressing portion 42 formed at a side area of the receiving portion 41. The receiving portion 41 includes at least one liquid container formed thereon; and the pressing portion 42 is configured to exert a pressure onto the liquid container and the lifting assembly 2. The liquid container comprises at least one container housing, a flexible portion formed at a side portion of the container housing and provided for the first piercing member 31 and the second piercing member 32 to selectively pierce therethrough as well as a container pace defined between the container housing and the flexible portion. The container space is stored with at least one fragrance material. In addition, it can be understood that the aforementioned structure is only a possible embodiment of the present invention, and the present invention is not limited to such embodiment only.

As shown in FIG. 1 to FIG. 7, it can be understood that during the installation of the liquid mixing apparatus of the present invention, the connecting device 1 installed on a fluid pipe in order to allow the fluid to enter into the flowing passage portion 113 via the fluid inlet 111 of the connecting main body 11 and to exit via the fluid outlet 112. At this time, since the first through hole 311 and the second through hole 321 are blocked by the connecting cover 12 along with the enhanced sealing effect of the sealing unit 34, the fluid cannot flow to the branch passage portion 114, the return passage portion 115, the first piercing member 31 or the second piercing member 32. In addition, the first piercing member 31 and the second piercing member 32 are received inside the piercing portion 23 of the second abutment member 22 of the lifting assembly 2 in order to prevent accidental injuries of the user etc.

Figure 5:
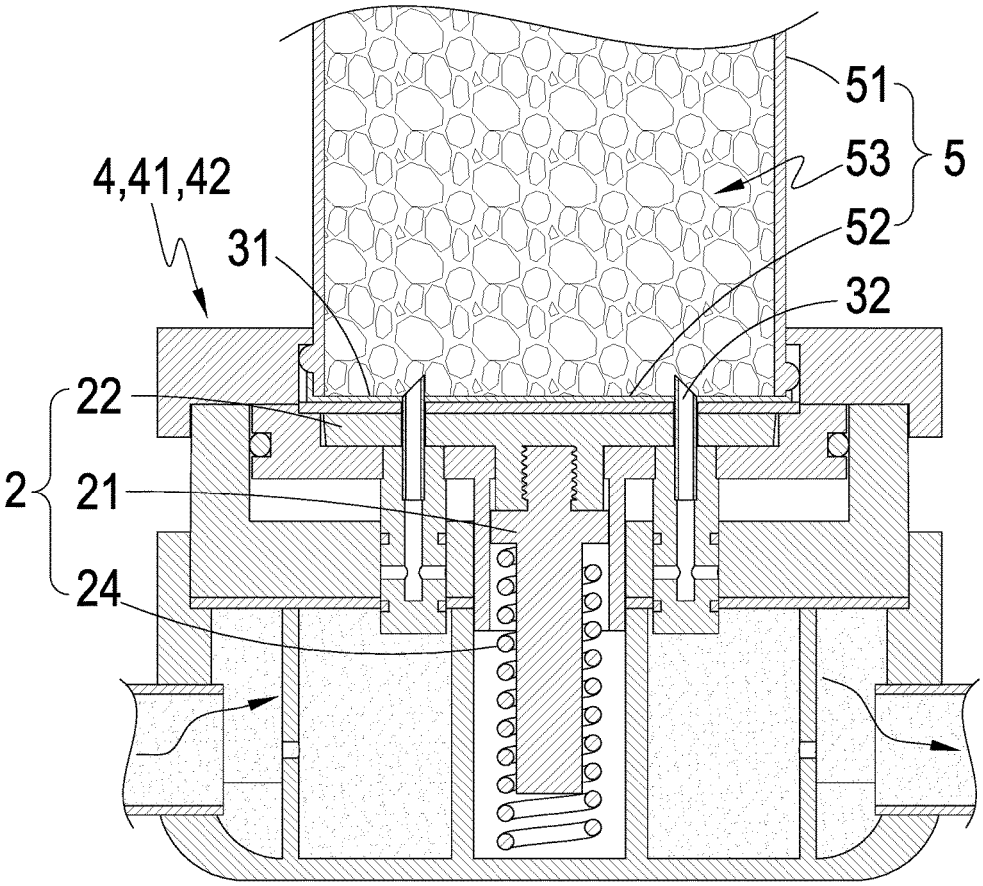
FIG. 5 is an illustration showing the piercing of the apparatus of the present invention.
Figure 6:
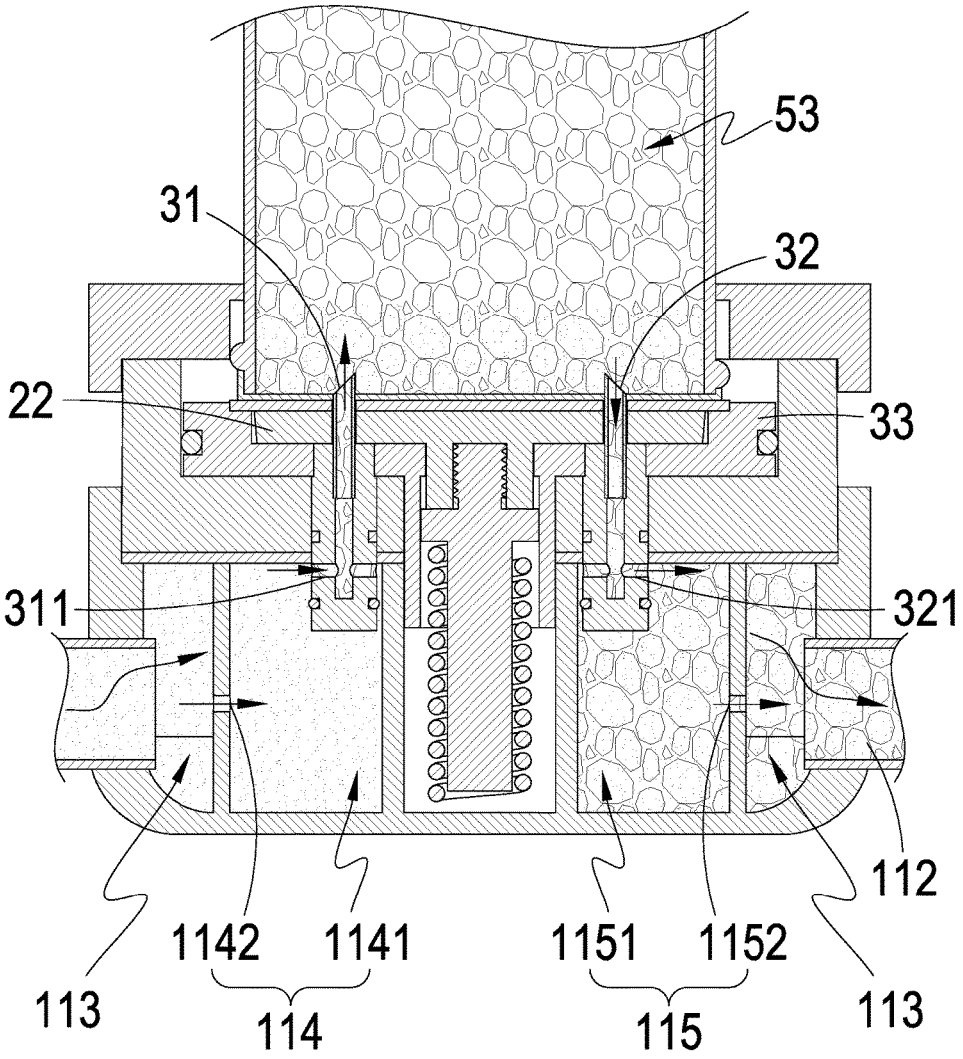
FIG. 6 is an illustration showing a state of use of the apparatus of the present invention.

Please refer to FIG. 5 and FIG. 6, when the user wishes to use the liquid mixing apparatus of the present invention, the liquid container 5 can be installed onto the receiving portion 41 of the adapter 4. Then, the pressing portion 42 can be used to exert a pressure onto the container housing 51 in order to allow it to press onto the lifting assembly 2 (the example of threaded fastening method for pressure exertion in this embodiment is used for illustration) in order to allow the second abutment 22 to move and to expose the first piercing member 31 and the second piercing member 32. The first piercing member 31 and the second piercing member 32 are able to naturally pierce through the flexible portion 52 to connect to the container space 53; in addition, the first abutment 21 is caused to move to press against the elastic unit 24 to store elastic energy. Next, the second abutment 22 is able to push the carrier 33 to drive the first piercing member 31 and the second piercing member 32 in order to allow the first through hole 311 to connect with the branch flow space 1141 of the branch passage portion 114. At the same time, the second through hole 321 is able to connect to the return flow space 1151 of the return passage portion 115. In addition, when the fluid switch (such as a faucet etc.) is turned on and the fluid inside the liquid mixing apparatus of the present invention starts to flow toward the direction of the fluid outlet 112, a portion of fluid inside the flowing passage portion 113 is able to flow into the branch flow space 1141 via the branch flow opening 1142 and to further flow toward the first through hole 311 of the first piercing member 31 in order to generate the pressurization effect. The pressurized fluid then flows into the container space 52 via the first piercing member 31 to contact with the fragrance material in order to generate a fragrant fluid. The fragrant fluid is able to flow toward t the flowing passage portion 113 via the second through hole 321, the return flow space 1151 and the return flow opening 1152 of the return passage portion 115, followed by exiting from the fluid outlet 112 for uses. Therefore, the apparatus is able to achieve the effect of deodorization, relaxation and increasing the living pleasure.

Figure 7:
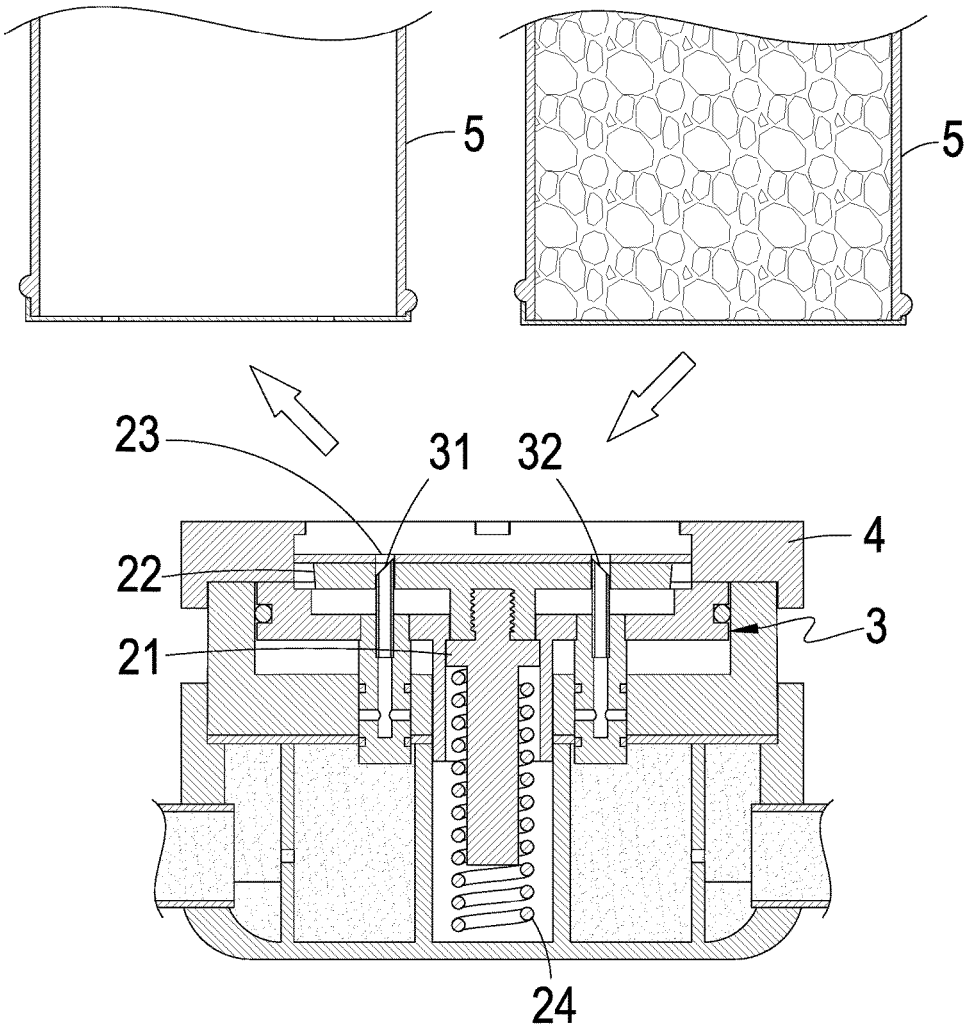
FIG. 7 is an illustration showing the replacement of the apparatus of the present invention.

Please refer to FIG. 7. When the liquid container is removed from the adapter 4 during replacement after use, the elastic unit 24 then restores to push the first abutment member 21, the second abutment member r22 and the piercing assembly 3 in order to allow the piercing portion 23 to receive the first piercing member 31 and the second piercing member 32 again to prevent accidental injuries of the user. Next, a brand new liquid container 5 can be installed onto the adapter 4; therefore, the liquid mixing apparatus of the present invention is extremely safe and convenient to use.

Furthermore, the structure of the liquid mixing apparatus of the present invention has the pressurization effect capable of generating the physical property of a high-pressure fluid to flow toward the direction of a low-pressure fluid naturally. Consequently, the fluid (high-pressure fluid) at the branch passage portion 114 is able to flow smoothly toward the fluid outlet 112 (low-pressure fluid). Moreover, with the pressurization effect generated by the present invention, the dimensions of the branch passage portion 114 and the return passage portion 115 can be increased in range while maintaining the pressurization effect. When there is a need on the change of the flow rate of the fluid for mixing, the dimensions of the branch passage portion 114 and the return passage portion 115 can be increased depending upon the needs in order to achieve the advantages of controllable amount of mixture for greater variation range.

In view of the above, when the liquid container 5 of the liquid mixing apparatus of the present invention is not installed, the piercing assembly 3 is able to allow the first through hole 311 an the second through hole 321 to be maintained under the sealed state. Consequently, the apparatus of the present invention is still allow the fluid to directly flow therethrough in order to maintain the normal use of the user (for example, the normal opening of shower head for shower, or normal opening of faucet for washing etc.) In addition, once the liquid mixing apparatus of the present invention is installed with the liquid container 5 and after the fluid switch (such as faucet etc.) is closed, since the fluid stops to flow into the branch passage portion 114 and the aforementioned fragrant fluid remains inside the return passage portion 115 without flowing out, the amount of mixture of the fluid with the fragrant material is then stopped, consequently, there is no need to remove the liquid container 5 immediately, and the mixing between the fluid and the fragrance material is stopped naturally such that unnecessary consumption of the fragrance material be reduced. When the fluid switch is turned on again, the flowing fluid is then re-mixed with the fragrance material. Therefore, regardless whether the fluid switch is under the closed state or opened state, the liquid container 5 can always be removed at any time without affecting the use of the fluid switch and the flowing fluid.

We claim:

1. A liquid mixing apparatus comprising:

at least one connecting device having one side formed of at least one fluid inlet and another side formed of at least one fluid outlet;

at least one flowing passage portion formed inside the connecting device and fluidly connected to the fluid inlet and the fluid outlet;

at least one branch passage portion formed inside the connecting device and located at a side area of the flowing passage portion and fluidly connected thereto;

at least one return passage portion formed inside the connecting device and located at the side area of the flowing passage portion and fluidly connected thereto;

at least one lifting assembly moveably arranged on the connecting device;

at least one piercing assembly moveably arranged on the lifting assembly, configured to move along therewith and located between the lifting assembly and the connecting device; the at least one piercing assembly comprising at least one first piercing member selectively connected to the branch passage portion and at least one second piercing member selectively connected to the return passage portion; the at least one first piercing member and the at least one second piercing member configured to selectively pierce through a side portion of the lifting assembly facing away from the connecting device; and at least one adapter arranged on the connecting device and at a location corresponding to the piercing assembly.

2. The liquid mixing apparatus according to claim 1, wherein the connecting device comprises at least one connecting main body formed of the fluid inlet, the fluid outlet, the flowing passage portion, the branch passage portion and the return passage portion thereon, and at least one connecting cover formed on the connecting main body and having the first piercing member and the second piercing member inserted therein.

3. The liquid mixing apparatus according to claim 1, wherein the branch passage portion comprises at least one branch flow space selectively connected to the first piercing member and at least one branch flow opening connected to the branch flow space and the flowing passage portion.

4. The liquid mixing apparatus according to claim 1, wherein the return passage portion comprises at least one return flow space selectively connected to the second piercing member and at least one return flow opening connected to the return flow space and the flowing passage portion.

5. The liquid mixing apparatus according to claim 1, wherein the lifting assembly comprises at least one first abutment member moveably arranged on the connecting device, at least one second abutment member arranged on a side portion of the first abutment member facing away from the connecting device and at least one elastic unit arranged on the first abutment member; and the first abutment member and the second abutment clamp to hold the piercing assembly; and the second abutment member configured to allow the first piercing member and the second piercing member to selectively pierce therethrough.

6. The liquid mixing apparatus according to claim 5, wherein the second abutment member includes a plurality of piercing portions defined thereon to allow the first piercing member and the second piercing member to selectively pierce therethrough; and the piercing portions are configured to selectively receive the first piercing member and the second piercing member.

7. The liquid mixing apparatus according to claim 1, wherein the piercing assembly comprises at least one carrier moveably arranged on the lifting assembly and provided for the first piercing member and the second piercing member to install thereon; and the first piercing member includes at least one first through hole formed thereon and selectively connected to the branch passage portion; the second piercing member includes at least one second through hole formed thereon and selectively connected to the return passage portion.

8. The liquid mixing apparatus according to claim 7, wherein at least one sealing unit is formed on top of the carrier, the first piercing member and the second piercing member.

9. The liquid mixing apparatus according to claim 1, wherein the adapter comprises at least one receiving portion, at least one pressing portion formed at a side area of the receiving portion; and the receiving portion includes at least one liquid container formed thereon; and the pressing portion is configured to exert a pressure onto the liquid container and the lifting assembly.

10. The liquid mixing apparatus according to claim 9, wherein the liquid container comprises at least one container housing, a flexible portion formed at a side portion of the container housing and provided for the first piercing member and the second piercing member to selectively pierce therethrough as well as a container pace defined between the container housing and the flexible portion.

* * * * *